United States Patent [19]

Knapp et al.

[11] 4,354,472

[45] Oct. 19, 1982

[54] FUEL INJECTION SYSTEM

[75] Inventors: Heinrich Knapp, Leonberg; Wolfgang Maisch, Schwieberdingen, both of Fed. Rep. of Germany

[73] Assignee: Robert Bosch GmbH, Stuttgart, Fed. Rep. of Germany

[21] Appl. No.: 146,867

[22] Filed: May 5, 1980

[30] Foreign Application Priority Data

May 28, 1979 [DE] Fed. Rep. of Germany ..... 2921604

[51] Int. Cl.[3] ..... F02B 3/00

[52] U.S. Cl. ..... 123/493; 123/454

[58] Field of Search ..... 123/453, 454, 493

[56] References Cited

U.S. PATENT DOCUMENTS 3,999,527 12/1976 Wessel et al. ..... 123/453

4,018,200 4/1977 Stumpp et al. ..... 123/453

4,243,002 1/1981 Freyer et al. ..... 123/453

*Primary Examiner*—Ronald B. Cox

*Attorney, Agent, or Firm*—Edwin E. Greigg

[57] ABSTRACT

A fuel injection system is proposed which can be triggered in such a manner that when control signals characterizing engine overrunning are present the fuel injection is interrupted. The fuel injection system includes metering valves, each of which is assigned one regulating valve, the movable valve element of which can be exposed on one side to the fuel pressure downstream of the pertinent metering valve and on the other side to the pressure in a control pressure line, which is limited on one side by a control throttle and on the other side by a control pressure valve. During engine overrunning, an electromagnetic valve which is disposed in a bypass that bypasses the control throttle or the control pressure valve or an electromagnetic valve in the control pressure line can be controlled in such a manner that the fuel pressure in the control pressure line increases and the regulating valves close, as a result of which the fuel injection is interrupted.

9 Claims, 2 Drawing Figures

FUEL INJECTION SYSTEM

BACKGROUND OF THE INVENTION

The invention relates to a fuel injection system as described herein. A fuel injection system is already known in which a bypass around the throttle valve is closed during overrunning. However, in such a system it is not assured that during overrunning of the internal combustion engine the fuel metering will be reliably interrupted, so as to reduce fuel consumption and the emission of toxic exhaust gas components.

OBJECT AND SUMMARY OF THE INVENTION

The fuel injection system according to the invention has the advantage over the prior art that during overrunning of the engine it is assured that the fuel injection is reliably interrupted, so that fuel is not consumed unnecessarily and exhaust gases are not unnecessarily emitted during overrunning.

As a result of the characteristics disclosed herein, advantageous further embodiments of and improvements to the fuel injection system disclosed are possible.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
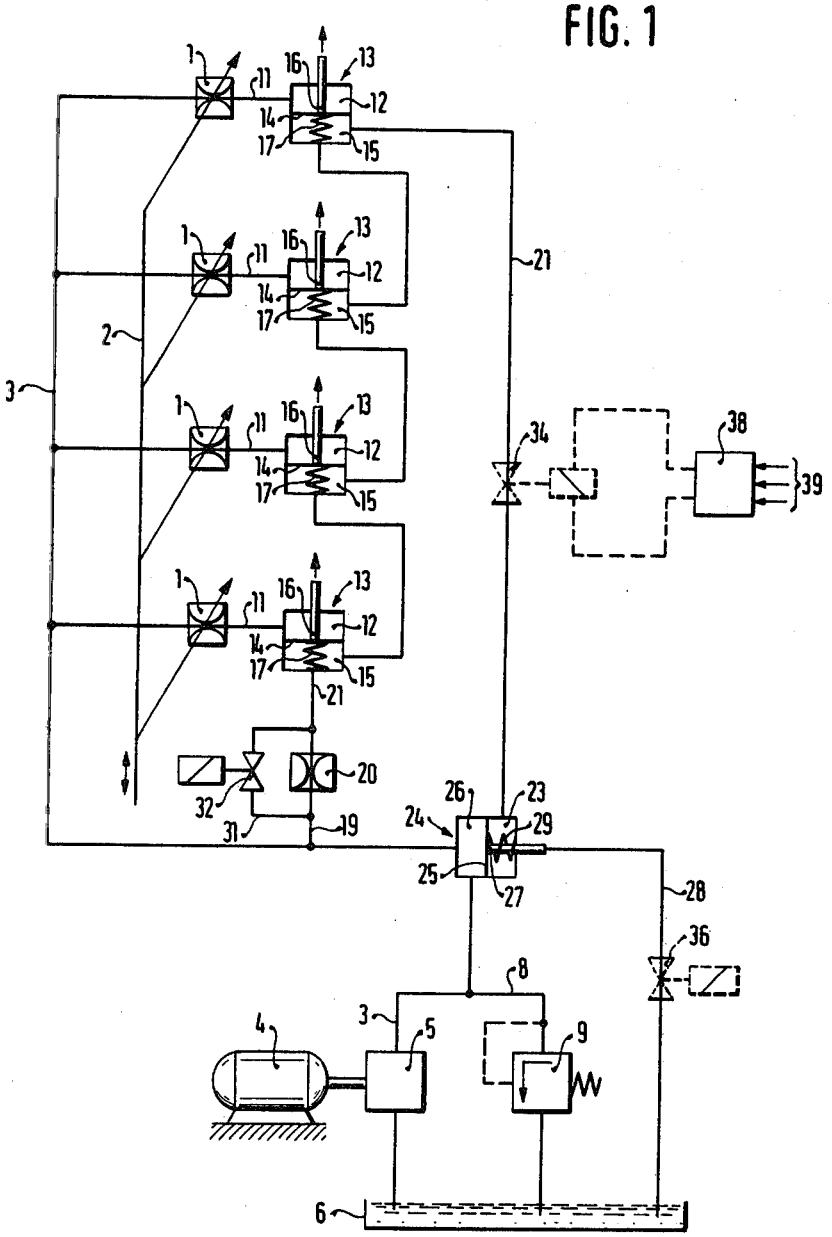
FIG. 1 shows a first exemplary embodiment of a fuel injection system with a shutoff of fuel injection during overrunning.

In the exemplary embodiment of a fuel injection system shown in FIG. 1, metering valves 1 are shown, one metering valve 1 being associated with each cylinder of a mixture-compressing internal combustion engine, not shown, with externally-supplied ignition. At the metering valve 1, a quantity of fuel is metered which is in a definite proportion to the air quantity aspirated by the engine. The fuel injection system shown by way of example has four metering valves 1 and is thus intended for a four-cylinder engine. The cross section of the metering valves is variable in common, as indicated by way of example, by an actuation element 2 in accordance with operating characteristics of the engine—for instance, in a known manner, in accordance with the quantity of air aspirated by the engine. The metering valves 1 are located in a fuel supply line 3, into which fuel is supplied from a fuel container 6 by a fuel pump 5, driven by an electromotor 4. A line 8 branches off from the fuel supply line 3, and a pressure limitation valve 9 is disposed in this branch line 8 which limits the fuel pressure prevailing in the fuel supply line 3 and causes fuel to flow back into the fuel container 6 if the pressure is exceeded.

Downstream of each metering valve 1, a line 11 is provided, through which the metered fuel proceeds into a chamber 12 of one regulating valve 13 separately assigned to each metering valve 1. The chamber 12 of the regulating valve 13 is separated by a movable valve element, embodied by way of example by a diaphragm

14, from a control chamber 15 of the regulating valve 13. The diaphragm 14 of the regulating valve 13 cooperates with a fixed valve seat 16 provided in the chamber 12 by way of which the metered fuel can flow out of the chamber 12 to the individual injection valves, not shown, in the intake manifold of the engine. A spring 17 of maximum resilience can also be disposed in the control chamber 15, on the one hand preventing fuel from flowing out of the fuel supply line 3 to the injection valves when the engine is shut off and on the other hand making it possible, during idling, for instance, for the fuel quantities metered at the individual metering valves 1 to be adapted to one another.

A line 19 branches off from the fuel supply line 3 and discharges via a control throttle 20 into a control pressure line 21. The control chambers 15 of the regulating valve 13 are in the control pressure line 21 downstream of the control throttle 20, and downstream from the control chambers 15 there is a first chamber 23 of a control pressure valve 24 embodied as a differential pressure valve 24. The first chamber 23 of the differential pressure valve 24 is separated from a second chamber 26 of the differential pressure valve 24 by a movable valve element embodied as a diaphragm 25, the second chamber 26 communicating upstream of the metering valves 1 with the fuel supply line 3. A fixed valve seat 27 is disposed in the first chamber 23 of the differential pressure valve 24, which cooperates with the diaphragm 25 and through which fuel can proceed out of the control pressure line 21 into a return flow line 28, which discharges into the fuel container 6. A spring 29 urging the diaphragm 25 in the opening direction of the differential pressure valve 24 is also disposed in the first chamber 23 of the differential pressure valve 24.

Now in order to assure in the desired manner that no fuel is injected into the engine during engine overrunning, resulting in a reduction in fuel consumption and in exhaust gas, a bypass line 31 around the control throttle 20 can be provided, which connects the line 19 and the control pressure line 21, bypassing the control throttle 20. An electromagnetic valve 32 is disposed in the bypass line 31 which is opened only when control signals characterizing overrunning are present and closes during other operational conditions of the engine, such as when there is no electric current running through the electromagnetic valve 32. By way of example, engine overrunning may be characterized by an engine throttle valve located in the idling position while at the same time the rpm are at a level higher than the engine idling level. If during engine overrunning the electromagnetic valve 32 is opened, then the fuel pressure of the fuel supply line 3 also prevails in the control chambers 15 of the regulating valves 13, so that the regulating valves 13, under the additional effect of the spring 17, close and prevent the delivery of fuel to the injection valves. If overrunning has ended, then there is no electric current in the electromagnetic valve 32 and it closes, so that the control pressure line 21 now communicates with the fuel supply line only via the control throttle 20, and the pressure in the control pressure line 21 is determined by the differential pressure valve 24.

Instead of providing for an interruption of fuel injection during engine overrunning by means of the electromagnetic valve 32 and the bypass line 31, this effect can also be attained as indicated in broken lines. That is, an electromagnetic valve 34 can be disposed in the control pressure line 21 downstream of the control chambers 15 of the regulating valves 13; normally, this valve 34 is open, and it is closed only by means of the control signals characterizing engine overrunning. A further possibility is the disposition of an electromagnetic valve 36 in the return flow line 28, which is also normally open and is closed only when control signals characterizing engine overrunning are present. When the electromagnetic valve 34 or 36 closes, the fuel pressure prevailing in the fuel supply line 3 is established in the control pressure line 21 and thus in the control chambers 15 of the regulating valves 13, and the regulating valves 13 close under the simultaneous additional effect of the springs 17. The electromagnetic valves 32, 34, 36 can be triggered in a known manner by an electronic control device 38, into which operational characteristics of the engine such as rpm, throttle valve position, and others can be fed as indicated by the arrows 39. It can also be efficient for the electromagnetic valves 32, 34, 36 to be triggerable in a clocked fashion for a predetermined period of time at the onset and at the end of overrunning, so that transitional states suitable for the shutoff and resumption of fuel supply are brought about. It could also be efficient to open the electromagnetic valve 23 briefly upon starting the engine, so that a rapid flushing of the control pressure line 21 can take place immediately after actuation of the engine starting switch; as a result, air and vapor bubbles which could possibly impair the starting of the engine are flushed out of the control pressure line 21, and rapid and sure starting of the engine is assured.

On the other hand, the electromagnetic valve 32 or 34 could also be closed upon starting of the engine, so that any gas bubbles which may be present in the system are compressed and any new formation of gas bubbles is prevented, and the engine can start reliably.

Figure 2:
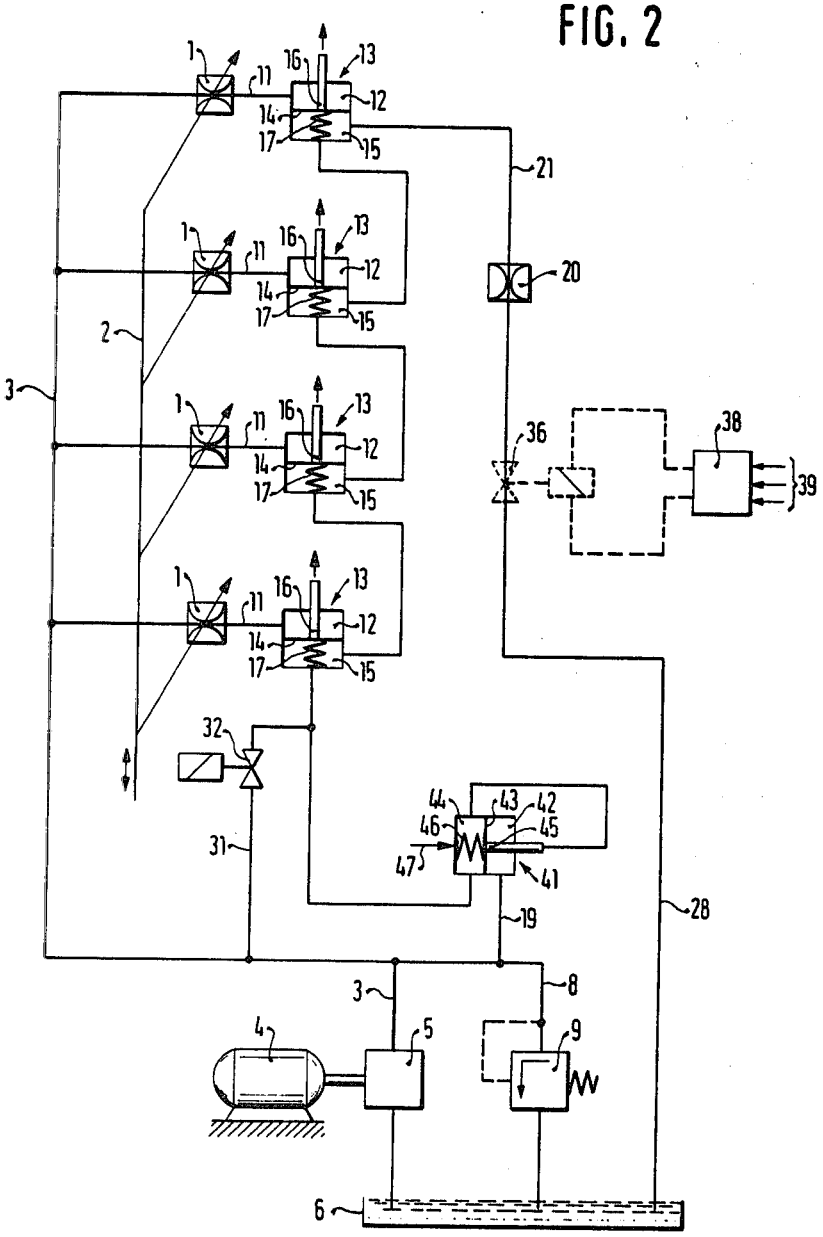
FIG. 2 shows a second exemplary embodiment of a fuel injection system with a shutoff of fuel injection during overrunning.

In the exemplary embodiment of a fuel injection system shown in FIG. 2, elements remaining the same as those of FIG. 1 have the same reference numerals. A feature which deviates in the exemplary embodiment of FIG. 2 from that of FIG. 1 is that the line 19 branching off from the fuel supply line 3 communicates with the control pressure line 21 via a differential pressure valve 41 embodied as a control pressure valve, and the control throttle 20 is disposed downstream of the control chambers 15 of the regulating valves 13. Thus, the fuel can flow via the control throttle 20 out of the control pressure line 21 into the return flow line 28 and from there into the fuel container 6. The differential pressure valve 41 again has a first chamber 42, which is separated by a diaphragm 43 from a second chamber 44. The first chamber 42 of the differential pressure valve 41 communicates with the line 19 and has a fixed valve seat 45, which cooperates with the diaphragm 43 serving as the movable valve element and through which fuel can flow out and can proceed into the second chamber 44 of the differential pressure valve 41, in which the same fuel pressure prevails as in the control chambers 15. In the second chamber 44 of the differential pressure valve 41, there is a spring 46 which urges the differential valve 41 in the closing direction. The force of the spring 46 can be affected by means of an additional force, indicated in the drawing by way of example by an arrow 47, in accordance with operational characteristics of the engine. An additional force 47 of this kind could also engage the spring 29 of the differential pressure valve 24 in the exemplary embodiment of FIG. 1. In the same manner as in the exemplary embodiment of FIG. 1, the electromagnetic valve 32 is disposed in the exemplary embodiment of FIG. 2 in the bypass 31 for the differential pressure valve 41. Normally, the electromagnetic valve 32 is closed and when control signals characterizing engine overrunning are present it opens, so that the differential pressure valve 41 in this operational state is hydraulically short-circuited and the regulating valves 13, because of the increased pressure and the force of the spring 17, also close, and the delivery of fuel to the injection valves is precluded. The bypass line 31 and the electromagnetic valve 32 may also be omitted if, instead, an electromagnetic valve 36 is disposed in the return flow line 28 downstream of the control throttle 20 or in the control pressure line 21 downstream of the control chambers 15 of the regulating valves 13 and is actuated in such a way that it is normally open, closing when control signals are present which characterize engine overrunning. In this exemplary embodiment, as well, the electromagnetic valve 32 or 36 could be triggered in clocked fashion for a predetermined period of time at the onset or at the end of overrunning, in order to provide improved transition conditions during shutoff or resumption of fuel delivery.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for mixture-compressing internal combustion engines with externally-supplied ignition, having controlable fuel metering valves disposed in a fuel supply line for controlably metering a fuel quantity to separate cylinders of said engine which is proportional to the air quantity aspirated by the engine, further wherein said fuel metering occurs at a constant pressure difference which is variable in accordance with operational characteristics of said engine, further having a regulating valve provided with movable valve elements disposed downstream of each fuel metering valve, said movable valve elements dividing said regulating valve into a fuel supply chamber which is connected with said metering valve and a fuel control chamber connected with a control pressure line and arranged to control said pressure difference at each fuel metering valve, each said fuel supply chamber of said regulating valve being exposed to fuel pressure downstream of the associated metering valve and said fuel control chamber of said regulating valve being exposed to pressure in a control pressure line connected to said control chamber of each of said regulating valves, said control pressure line being pressure limited on a fuel supply end by a control throttle connected to said fuel supply line and on a fuel return end by a control pressure valve disposed downstream of said control chamber, said control pressure line communicating via said control throttle with said fuel supply line, an electromagnetic valve connected in said control pressure line operative in response to control signals, characterized in that pressure in said control pressure line can be influenced by operation of said electromagnetic valve, by means of control signals characterizing engine overrunning so that the regulating valves close and fuel injection is interrupted due to fuel pressure resulting from operation of said electromagnetic valve.

2. A fuel injection system as defined by claim 1, including a bypass line around said control throttle, said electromagnetic valve is connected in said bypass line, and said electromagnetic valve is arranged to open when control signals characterizing engine overrunning are present.

3. A fuel injection system as defined by claim 1, characterized in that said control pressure line communicates via said control throttle with said fuel supply line; said regulating valves include control chambers; said control chambers of said regulating valves, said control pressure valve and said electromagnetic valve are disposed downstream of said control chamber, and said electromagnetic valve closes in response to control signals characterizing engine overrunning.

4. A fuel injection system as defined by claim 1, characterized in that said control pressure line communicates via said control pressure valve with said fuel supply line and further that said regulating valves are disposed downstream from said control throttle, said control throttle also being disposed downstream of said control pressure valve and said electromagnetic valve opens when control signals characterizing engine overrunning are present is located in a bypass line which bypasses said control pressure valve.

5. A fuel injection system as defined by claim 1, characterized in that said control pressure line communicates via said control pressure valve with said fuel supply line and further that said regulating valves are disposed downstream from said control throttle, said control throttle also being disposed downstream of said control pressure valve and said electromagnetic valve is disposed downstream of said control throttle, which electromagnetic valve closes when control signals characterizing engine overrunning are present.

6. A fuel injection system as defined by claim 1, characterized in that said control pressure valve comprises a differential pressure valve element.

7. A fuel injection system as defined by claim 6, characterized in that said control pressure valve has a spring loaded valve element disposed on one side to said fuel pressure in said control pressure line and on the other side to the fuel pressure upstream of said metering valves.

8. A fuel injection system as defined by claim 1, characterized in that said control pressure valve comprises a differential pressure valve, said differential pressure valve further including a movable valve element exposed on one side to said fuel pressure upstream of said metering valves and on the other side thereof to said fuel pressure in said control pressure line and the force of a spring.

9. A fuel injection system as defined by claim 2, characterized in that said electromagnetic valve is arranged to respond to said control signals characterizing engine overrunning, and said electromagnetic valve further adapted to be triggered in clocked fashion for a predetermined period of time at the onset and at the end of overrunning.

* * * * *